US008506342B2

(12) United States Patent
Masoud et al.

(10) Patent No.: US 8,506,342 B2
(45) Date of Patent: Aug. 13, 2013

(54) HIGH BRIGHTNESS EXCIMER LAMP

(75) Inventors: Nazieh Mohammad Masoud, Brookfield, WI (US); Daniel E. Murnick, Bernardsville, NJ (US)

(73) Assignee: Rutgers, The State University, New Brunswick, NJ (US)

( * ) Notice: Subject to any disclaimer, the term of this patent is extended or adjusted under 35 U.S.C. 154(b) by 0 days.

(21) Appl. No.: 13/246,964

(22) Filed: Sep. 28, 2011

(65) Prior Publication Data

US 2012/0049767 A1 Mar. 1, 2012

Related U.S. Application Data

(62) Division of application No. 12/072,108, filed on Feb. 22, 2008, now Pat. No. 8,049,417.

(51) Int. Cl.
*H01J 9/24* (2006.01)
*H01J 17/20* (2006.01)

(52) U.S. Cl.
USPC ..... 445/23; 313/573

(58) Field of Classification Search
USPC ..... 315/248; 313/110, 573; 445/23
See application file for complete search history.

(56) References Cited

U.S. PATENT DOCUMENTS

| | | | | |
|---|---|---|---|---|
| 5,686,789 | A | 11/1997 | Schoenbach et al. | |
| 5,949,180 | A * | 9/1999 | Walker | 313/113 |
| 6,087,774 | A | 7/2000 | Nakayama et al. | |
| 6,204,605 | B1 | 3/2001 | Laroussi et al. | |
| 6,858,988 | B1 * | 2/2005 | Laroussi | 315/111.21 |
| 2005/0094940 | A1 | 5/2005 | Gao | |
| 2007/0132408 | A1 | 6/2007 | Salvemoser et al. | |

* cited by examiner

*Primary Examiner* — Anne Hines
*Assistant Examiner* — Jacob R Stern
(74) *Attorney, Agent, or Firm* — Lerner, David, Littenberg, Krumholz & Mentlik, LLP

(57) ABSTRACT

A high brightness excimer light source has an elongated tube containing an excimer-forming gas and electrodes for exciting the gas to form a plasma, and thus create excimers such as a rare gas halogen excimer or a rare gas excimer. Light emitted from the excimer propagating axially along the tube passes out of the tube through an exit device such as a lens or optical fiber at one or both ends of the tube.

4 Claims, 3 Drawing Sheets

HIGH BRIGHTNESS EXCIMER LAMP

CROSS-REFERENCE TO RELATED APPLICATIONS

The present application is a divisional of U.S. patent application Ser. No. 12/072,108, filed Feb. 22, 2008, the disclosure of which is incorporated herein by reference.

FIELD OF THE INVENTION

The present invention relates to light sources and methods of operating the same.

BACKGROUND OF THE INVENTION

As described, for example, in U.S. Patent Publication No. 2007/0132408 ("the '408 Publication"), the disclosure of which is incorporated by reference herein, light in the spectral region below about 400 nanometers wavelength, normally referred to as "ultraviolet" or "UV" light, and particularly between about 100-200 nanometer wavelength, commonly referred to as the "vacuum ultraviolet" or "VUV" region of the spectrum, can be generated by forming excimers. Excimers are transient molecules composed of atoms that do not normally combine with one another. One or more of the atoms constituting an excimer is in an excited state, i.e., a state in which the atom has been momentarily promoted to a higher energy state as, for example, by promoting one or more electrons to higher energy orbitals. The excimer molecule as a whole is also in an excited state, and will ultimately decay to yield the constituent atoms. Decay of certain excimers is accompanied by emission of ultraviolet light.

Elements commonly referred to as "rare gases" or "inert gases," such as helium, neon, argon, krypton, and xenon, which normally exist only as isolated atoms, can form excimers. For example, diatomic rare gas excimers such as $Ar_2$*, $Kr_2$*, and $Xe_2$* will emit radiation in the VUV range upon decay to the constituent atoms. Other excimers can be formed by combination of a rare gas and a halogen atom. For example, excimers such as ArF* and XeCl* emit light at about 193 nm and about 308 nm, respectively.

As described in the '408 Publication, excimers of this type can be formed by applying radiofrequency ("RF") energy between a pair of electrodes disposed in a chamber containing the gas. In one embodiment, the UV light source according to the '408 Publication includes electrodes disposed at a small spacing, as for example, about 1 mm or less, within a chamber. A gas mixture containing a rare gas, a halogen, and typically also containing a diluent such as helium, neon, or argon which does not constitute a constituent of the excimer to be formed, is supplied within the chamber. RF energy is applied between the electrodes so as to form a discharge. Such a light source provides a bright and stable point source for UV illumination. Typically, the chamber includes a window which is transparent to the emitted UV light.

UV sources of this type can be applied in many different industrial and scientific processes, as for example, in photolithographic processes for forming semiconductor devices and other structures of comparable dimensions; in fingerprint detection; in microscopy; and in excitation of certain chemical reactions.

As described in Laroussi, U.S. Pat. No. 6,858,988, an "electrodeless" excimer lamp has a chamber formed from a dielectric material such as glass or quartz, and surrounded by ring-like electrodes. The chamber is filled with an excimer-forming gas mixture. RF energy applied between the electrodes provides an electric field within the chamber, which also creates a plasma within the chamber and leads to formation of excimers. As shown in Laroussi '988, the emitted light is essentially isotropic, and is emitted in all directions through the sides of the chamber for applications such as disinfecting liquids surrounding the chamber. Because the electrodes do not directly contact the excimer-forming gas mixture, the system is referred to as an "electrodeless" discharge lamp.

Despite the considerable efforts in the art devoted to creation of useful UV light sources, still further improvement would be desirable. In particular, it would be desirable to provide a UV light source with very high brightness in a concentrated spot.

SUMMARY OF THE INVENTION

One aspect of the invention provides an ultraviolet light source. The source according to this aspect of the invention desirably includes an elongated tube having first and second ends and an axial direction between the ends. An excimer-forming gas desirably is disposed within the tube. A light exit device is mounted adjacent a first end of the tube, so that light passing generally axially along the tube may escape from the tube. The source according to this aspect of the invention desirably also includes a plurality of electrodes spaced apart from one another along the length of the tube. The electrodes are constructed and arranged so that upon application of RF energy to the electrodes, an electrical discharge occurs within the excimer-forming gas disposed within the tube. The excimer-forming gas will form a plasma containing excimers within the tube and the excimers will decay and emit ultraviolet light. At least some of the ultraviolet light is directed generally axially within the tube into the light exit device. As further discussed below, the axially-directed light provides an intense beam.

A further aspect of the invention provides methods of generating ultraviolet light. A method according to this aspect of the invention desirably includes applying energy to an excimer-forming gas disposed in an elongated tube so as to generate excimers in the gas, so that light emitted from the excimers propagates axially along the tube, and capturing light propagating axially along the tube at one or both ends thereof.

DETAILED DESCRIPTION

Figure 1:
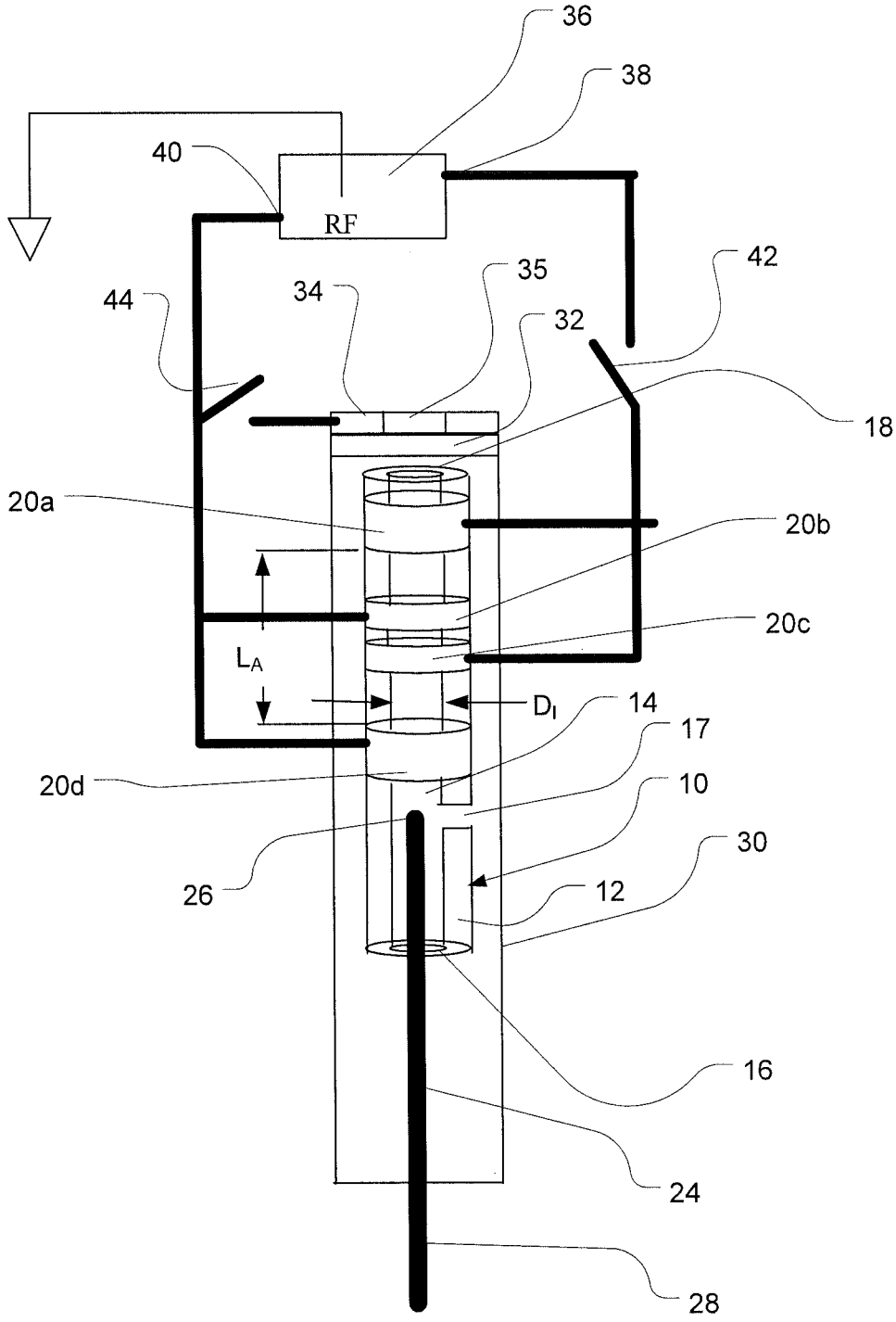
FIG. 1 is a diagrammatic view of a light-emitting apparatus according to one embodiment of the invention.

A light source according to one embodiment of the invention includes an elongated tube 10 having a wall 12 defining an interior bore 14. The tube extends generally in an axial direction between a first end 16 and a second end 18, and is open at both ends. A port 17 extends through wall 12 near the first end 16. Wall 12 desirably is formed from a dielectric material such as glass, quartz, fused silica, or other material which is substantially resistant to corrosion by halogen plasmas. Also, the interior surface of the wall, directly bounding the interior bore 14, desirably is a smooth, cylindrical surface.

Electrodes 20 formed from a conductive material such as a metal are provided on the exterior surface of wall 12 at spaced-apart locations along the length of the tube, between the first and second ends. As further discussed below, a plasma will be formed and light will be emitted from excimers within the plasma by application of electrical energy to the electrodes. Thus, emission will occur primarily in that region of the tube between the electrodes. The "active length" $L_A$ as used herein with reference to a tube having electrodes refers to the largest axial distance between electrodes, i.e., the distance between the closest points of the two electrodes which are furthest from one another. The middle pair 20*b* and 20*c* of electrodes are relatively closely spaced; the axial distance between adjacent edges of these electrodes desirably is about 2 mm. The end electrodes 20*a* and 20*d* are spaced relatively far from the center electrodes. For example, the axial distance between adjacent edges of electrodes 20*a* and 20*b* desirably is about 4 mm, whereas the axial distance between electrodes 20*c* and 20*d* is also about 4 mm.

Tube 10 desirably is long and narrow. Thus, the interior diameter $D_I$ of bore 14 desirably is less than about 1 mm, and more preferably about 0.5 mm or less. The active length $L_A$ typically is several centimeters, most commonly about 2 cm or more, desirably about 5 cm or more, and can be made even longer. Thus, the aspect ratio, or ratio of $L_A$ to $D_I$, desirably is about 10 or more, and typically is even higher, as for example, about 20 or more, and even more desirably about 100 or more.

A light exit device in the form of a fiber 24 is provided adjacent the first end 16 of the tube. Fiber 24 has an end 26 projecting into the interior bore 14 of the tube from the first end of the tube. The diameter of fiber 24 is somewhat smaller than the interior diameter $D_I$ of the tube, so that there is an opening at first end 16 around the fiber. Fiber 24 may be formed from any material which is optically transmissive to the light which will be emitted by the excimer, as for example, a fused silica fiber having a 200 μm core or other UV-transmitting fiber for use with 308 nm UV light. The end 28 of fiber 24 remote from the tube may be connected to any device capable of using the UV light in a desired manner.

A reservoir 30 surrounds tube 10 and communicates with the tube through the first end 16 and second end 18, as well as through port 17. Reservoir 30 may be formed from any material which can contact the excimer-forming gas without contaminating the same, but typically is formed from a dielectric material such as glass or quartz. Reservoir 30 is filled with an excimer-forming gas, as for example, a mixture of xenon, chlorine, neon, and argon. The end of reservoir 30 adjacent second end 18 is closed by a dielectric wall 32 transparent to the light which will be emitted. A starting electrode 34 overlies wall 32. Starting electrode 34 has an opening 35 aligned with tube 10.

Typically, the excimer-forming gas is at a substantial absolute pressure, as for example, at least about 0.3 bar, and more preferably 0.3 bar to 1.5 bar. In the case of an excimer-forming gas which includes a rare gas and a halogen, the rare gas which acts as a constituent of the excimer typically constitutes about 1 to about 10 mole percent, whereas the halogen typically constitutes about 0.01 to about 5 mole percent, the remainder of the gas being a diluent such as a rare gas which does not act as a constituent of the excimer. For example, where Xe and Cl are used to form XeCl*, the diluent may be neon, argon, or a combination of these. The excimer-forming gas may contain other constituents, provided that these do not interfere with the desired reaction. In particular, extraneous constituents or contaminants which tend to form long-lived electronegative ions tend to inhibit excimer formation. Thus, the excimer-forming gas desirably is substantially free of such species, and should contain less than 10 ppm of such species; in particular, less than 10 ppm of water vapor.

The apparatus further includes an RF power supply 36 arranged to apply an RF potential between a first output node 38 and a second output node 40. Electrodes 20 are connected to output nodes 38 and 40 so that electrodes disposed at mutually adjacent locations along the length of tube 10 are connected to opposite nodes. Thus, electrode 20*a* is connected to node 38, whereas the next adjacent electrode 20*b* is connected to node 40. The next electrode 20*c* along the length of the tube is connected to node 38. The furthest electrode 20*d* along the length of the tube is connected to node 40. A switch 42 is connected between one node 38 and the associated electrodes 20*a* and 20*c*.

Starting electrode 34 is connected through a starting switch 44 to node 40. Thus, the starting electrode 34 is connected to the opposite node from the electrode 20*a* nearest to the second end 18 of the tube, and nearest to the starting electrode.

RF source 36 is arranged to apply an alternating potential at least about 100 KHz, more typically about 5 MHz to about 10 MHz, and most commonly about 6 MHz between nodes 38 and 40. The RF source 36 applies the RF energy in a pulsatile fashion, typically in pulses of less than about 100 microseconds (μs) on-time, and more typically about 10 to about 100 μs on-time, at a pulse rate varying from a few Hz to about 1 KHz. The RF energy desirably applies a potential of a few hundred to a few thousand volts between the electrodes.

In operation, switch 42 is closed so as to connect the RF potential source to the electrodes 20 on the tube. Upon application of the RF potential to the electrodes, a plasma typically forms within the active region of tube 10, inside bore 14.

If an electrical discharge does not form promptly upon closure of switch 42, switch 44 may be closed so as to apply the potential between starting electrode 34, and end electrode 20*a*. Once the discharge is initiated, switch 44 is opened and the discharge is maintained using only electrodes 20*a*-20*d*. The electrical discharge within the interior bore 14 causes formation of a plasma and reaction of the rare gas and halogen to form a rare gas-halogen excimer. The excimer decays and emits ultraviolet light.

Any infinitesimal volume within the plasma will emit light in substantially all directions at substantially the same intensity. However, light propagating in the axial directions along the length of tube 10 is reinforced by emissions from all other portions of the gas along the length of the tube, so that the light propagating in the axial directions towards the ends of the tube is substantially more intense than light propagating transverse to the axis, toward the wall of the tube.

Although the present invention is not limited by any theory of operation, it is believed that this phenomenon occurs in part because the light is being emitted from an excimer. The emission involves transition from the excited state, as for example, XeCl* to a lower-energy state which decays essentially instantaneously. Thus, there is no population of species in the lower-energy state which can absorb light at the emitted wavelength and transition back to the higher-energy excited state. Stated another way, the plasma is essentially entirely transparent to the emitted light. Thus, light emitted from the plasma near the second end 18 of the tube and passing axially toward the first end 16 is reinforced by further emission from portions of the plasma nearer the second end, but is not absorbed by those portions of the plasma. The same phenomenon occurs for light passing in the opposite axial direction. The degree of reinforcement is directly related to the length of the emitting plasma traversed by the light, and hence directly related to the active length $L_A$ of the apparatus.

This phenomenon is in contrast to the situation which occurs in a normal gas discharge. In such a discharge, the emission involves a transition from a higher-energy state to a lower-energy state, and there is a substantial population of gas species in the lower-energy state. Thus, light emitted from one portion of the gas passing through another portion of the gas is reinforced by emissions from such other portion, but also absorbed by such other portion, so that the intensity does not increase with distance traveled through the plasma.

Additionally, light passing generally axially along the length of the tube is reinforced by reflection from wall 12 of the tube. Thus, light directed at a slight angle to the axial direction will hit the wall at a grazing angle, and will be reflected along the length of the tube.

All of these factors contribute to an extremely intense beam of light propagating axially along the length of the tube. This intense beam propagates in both directions along the length of the tube. It exits from the tube through end wall 32 and opening 35 and through the end 26 of fiber 24. The light passing into the fiber through end 26 propagates along the fiber to end 28, and is emitted from end 28 into the desired light-using device (not shown).

With a tube having a diameter of about 0.5 mm and a fiber having a diameter of about 0.2 mm, approximately 8% of the light propagating axially toward the first end of the tube is coupled into the fiber. Thus, fiber 24 acts as a light exit device at the first end 16 of tube 10.

The end wall 32 and opening 35 allow light to exit from the second end 18 of the tube and pass out of the system, and thus act as a light exit device at second end 18. In this embodiment, the light exiting at the second end of the tube, through end wall 32 and opening 35, typically is used for monitoring operation of the device. Thus, a measuring instrument (not shown) can be aligned with opening 35 to measure the emitted light output. The opening 35 may be capped when the measuring device is not in use. However, the light exiting at the second end can be used for any purpose.

Figure 2:
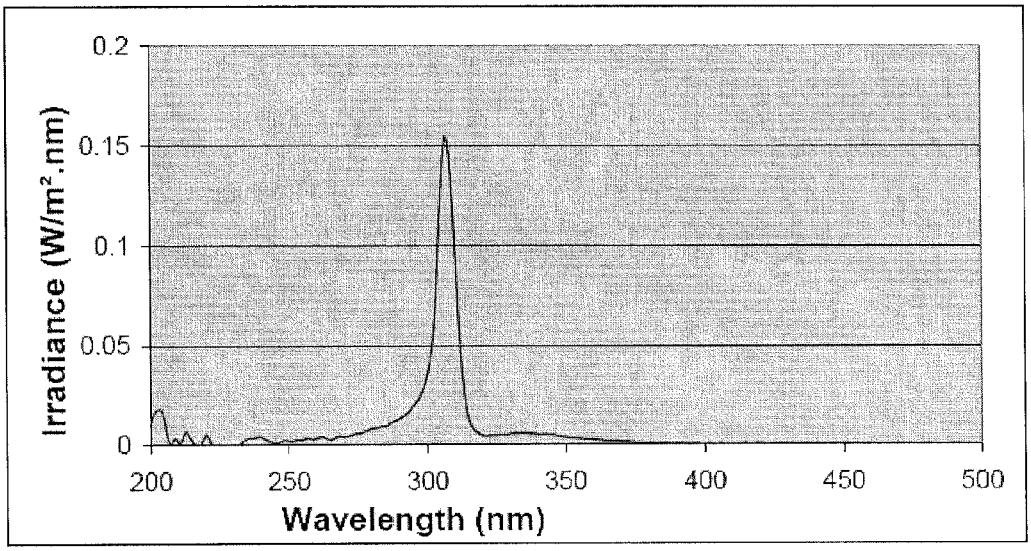
FIGS. 2 and 3 are graphs depicting certain performance characteristics of the apparatus as shown in FIG. 1.
Figure 3:
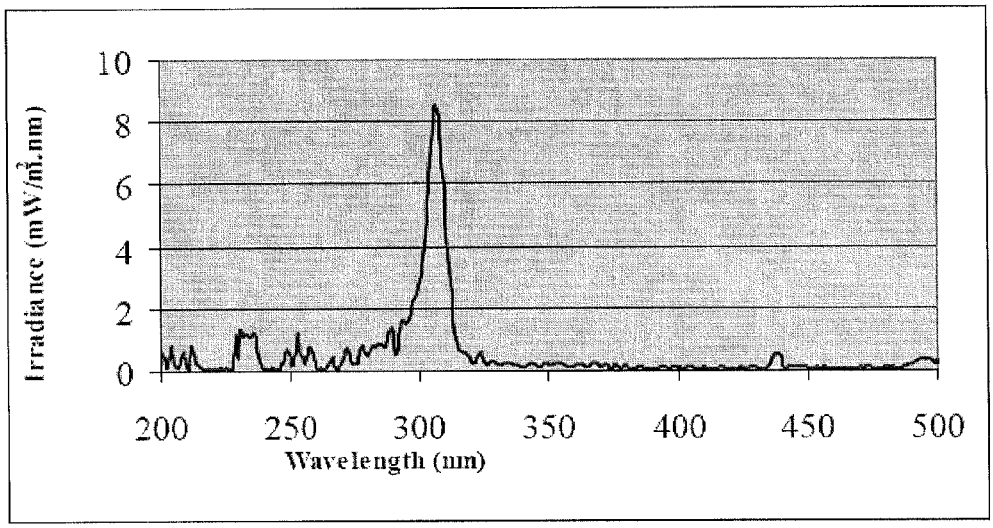

The light source provides an extremely intense beam with low divergence. For example, using an XeCl* excimer-forming gas, with 50 μs pulses at a pulse rate of 500 Hz, the output power is about 10 mW. The beam exiting through window 32, measured at a distance of about 5 nm from the second end 18 of the tube, has spectral irradiance as shown in FIG. 2. The spectral irradiance of the beam exiting through the end 28 of the fiber is as shown in FIG. 3. The radiance of the beam exiting through end wall 32 and opening 35 is quite high, on the order of 3 $w/mm^2 \cdot sr$ or more. The UV light source according to this embodiment thus provides high radiance and irradiance, commonly referred to as "high brightness," with a spectrum narrowly concentrated around the 308 nm wavelength of the XeCl* excimer UV emission.

During operation, the excimer-forming gas within the interior bore 14 of the tube is continually replenished by convective transfer between the interior of the tube and the surrounding reservoir 30. Here again, although the present invention is not limited by any theory of operation, it is believed that such continual replenishment avoids depletion of certain species present in the excimer-forming gas which could occur with a very small volume of excimer-forming gas confined within the interior bore of the tube. As convective transfer occurs, gas depleted in some species passes back into the chamber. While the gas is in the reservoir, species such as relatively long-lived ions decay to return the gas to its original composition and thus restore the depleted species. The convective transfer occurs through the open second end 18 of the tube and through port 17, as well as through the space surrounding fiber 24 at the first end 16 of the tube.

The emission from the apparatus remains stable. For example, the apparatus can operate continuously for hundreds of hours, with essentially no change in UV output power. Because the electrodes 20 are not exposed to the plasma, the electrodes do not corrode or erode appreciably, so that metal from the electrodes does not deposit within the tube.

Figure 4:
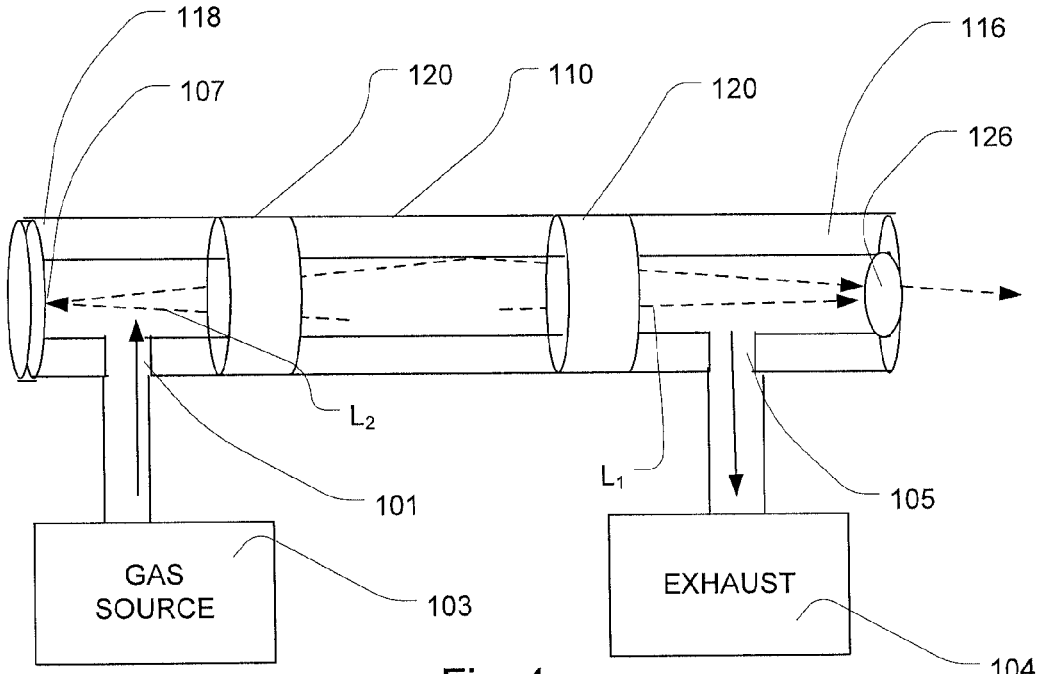
FIG. 4 is a diagrammatic view depicting apparatus according to a further embodiment of the invention.

Numerous variations and combinations of the features discussed above can be utilized. For example, the starting electrode 34 discussed above with reference to FIG. 1 can be omitted. In the embodiment shown in FIG. 4, tube 110 is provided with only two electrodes 120 spaced along its length, and no starting electrode is provided. As in the embodiment of FIG. 1, the electrodes 120 are connected to an RF source (not shown). Also, the tube 110 of FIG. 4 is not enclosed by an external reservoir, but instead is connected via a port 101 adjacent one end of the tube to a gas source 103, arranged to supply a continuous in-flow of excimer-forming gas. A further port 105 adjacent the opposite end of the tube connects the interior of the tube to an exhaust system 104. In a further embodiment, the gas source 103 and exhaust system 104 can be replaced by a reservoir connected to both ports 101 and 105, so that the gas continually circulates through the tube, ports and reservoir. In such a system, the gas has sufficient dwell time in the reservoir for substantial decay of long-lived species formed within the tube. Such a system may rely entirely on convection to maintain flow, or may incorporate mechanical elements to forcibly move the gas.

In the embodiment of FIG. 4, a mirror 107 is provided in alignment with the interior bore of the tube at the second end 118. The mirror will reflect light propagating towards the second end, back towards the first end 116 of the tube. In this embodiment, the first end 116 of the tube is provided with a light exit device in the form of a lens 128 for focusing the light. Thus, as indicated by the broken arrows in FIG. 4, light $L_2$ emitted in the axial direction toward the second end is reflected back toward the first end 116, where it reinforces the light $L_1$ emitted from the plasma toward the first end 116, so as to provide an even stronger beam exiting from the first end of the tube.

The light exit device or devices may include essentially any device which will allow the light to pass out of the tube to its point of intended use. Thus, in addition to the fibers, windows, and lenses discussed above, a light exit device may include a simple window; a gradient index lens; an ordinary lens; a diffraction grating; or essentially any other optical device capable of allowing the light to exit. Light exit devices may be provided at both ends of the tube. In a further embodiment, where the light is to be directed onto a workpiece which can be housed within a reservoir filled with the excimer-forming gas together with the tube, one or both ends of the tube may simply be left open so that the light can pass out of the open end of the tube. In this instance, the open end of the tube serves as a light exit device. The light exit device desirably does not reflect a substantial portion of the light back into the tube.

The gas source 103 and exhaust 104 can be actuated so as to control the pressure within the interior of tube 110 and maintain the desired flow. For example, the gas source and exhaust may be actuated to provide a very low pressure during start-up, so that the potential applied between electrodes 120 can initiate the discharge and form a plasma in the active region of the tube between the electrodes. Once the discharge has been initiated, the gas source and exhaust can be operated to gradually increase the pressure to the desired level for emission of a bright beam.

In yet another alternative, the tube may be entirely sealed. This arrangement is best suited to intermittent operation. In the embodiments discussed above, the electrodes are disposed on the outside of the tube, and are capacitively coupled to the excimer-forming gas through the dielectric wall of the tube. In a further variant, however, the electrodes may be disposed inside the tube, in contact with the excimer-forming gas.

A wide variety of excimer-forming gases may be employed. However, as discussed above, the excimer which is formed desirably is one which decomposes substantially instantaneously upon emission, so that there is no substantial population of lower-energy state molecules capable of undergoing a reverse transition to the excimer upon absorption of the emitted light. Among the excimers which can be employed are those shown in Table I below:

TABLE I

| Excimer | λ (nm) |
|---|---|
| NeF * | 108 |
| $Ar_2$ * | 129 |
| $Kr_2$ * | 147 |
| $F_2$ | 158 |
| $Xe_2$ * | 172 |
| ArCl * | 175 |
| KrI * | 185 |
| ArF * | 193 |
| KrBr * | 206 |
| KrCl * | 222 |
| KrF * | 249 |
| XeI * | 253 |
| $Cl_2$ | 258 |
| XeBr * | 282 |
| $Br_2$ * | 290 |
| XeCl * | 308 |
| $I_2$ * | 343 |
| XeF * | 346 |
| $Kr_2F$ * | 415 |
| $Na_2$ * | 437 |
| HgI * | 443 |
| $Li_2$ * | 459 |
| HgBr * | 502 |
| XeO * | 547 |
| HgCl * | 558 |

TABLE I-continued

| Excimer | λ (nm) |
|---|---|
| $K_2$ * | 575 |
| $Rb_2$ * | 605 |
| CdI * | 655 |
| $Cs_2$ * | 713 |
| CdBr * | 811 |

As these and other variations and combinations of the features discussed above can be utilized without departing from the present invention, the foregoing description of the preferred embodiments should be taken by way of illustration rather than by way of limitation of the invention as set forth in the claims.

The invention claimed is:

1. A method of providing ultraviolet light comprising the steps of:

(a) applying energy to an excimer-forming gas disposed in an elongated tube having an aspect ratio of at least about 10, and an internal diameter of less than about 1 mm so as to generate excimers in the gas so that ultraviolet light emitted from the excimers propagates axially along the tube, wherein the tube is at least partially reflective to the emitted ultraviolet light; and (b) capturing light propagating axially along the tube at one or both ends thereof.

2. A method as claimed in claim 1 wherein the excimer-forming gas is substantially free of species which absorb the light emitted by the excimers.

3. A method as claimed in claim 2 wherein the excimer-forming gas includes a rare gas and a halogen, and wherein the excimers are of the form RGZ* where RG is a rare gas and Z is a halogen.

4. A method as claimed in claim 2 wherein the step of capturing light includes capturing light in a fiber at at least one end of the tube.

* * * * *